US011187228B2

(12) United States Patent
Shi

(10) Patent No.: US 11,187,228 B2
(45) Date of Patent: Nov. 30, 2021

(54) LIQUID PUMPING DEVICE WITH CONCAVE CAVES AND CONVEX LIQUID EXTRUDING COMPONENT

(71) Applicant: Yuyang Shi, Zhejiang (CN)

(72) Inventor: Yuyang Shi, Zhejiang (CN)

( * ) Notice: Subject to any disclaimer, the term of this patent is extended or adjusted under 35 U.S.C. 154(b) by 94 days.

(21) Appl. No.: 16/632,882

(22) PCT Filed: Jul. 25, 2018

(86) PCT No.: PCT/CN2018/097126
§ 371 (c)(1),
(2) Date: Jan. 22, 2020

(87) PCT Pub. No.: WO2019/020063
PCT Pub. Date: Jan. 31, 2019

(65) Prior Publication Data

US 2021/0071661 A1 Mar. 11, 2021

(30) Foreign Application Priority Data

Jul. 26, 2017 (CN) ..... 201710616433.3

(51) Int. Cl.
*F04C 5/00* (2006.01)
*F04C 13/00* (2006.01)

(52) U.S. Cl.
CPC ..... *F04C 5/00* (2013.01); *F04C 13/00* (2013.01); *F04C 2210/20* (2013.01); *F04C 2240/802* (2013.01)

(58) Field of Classification Search
CPC ..... F04C 13/00; F04C 2240/802; F04C 5/00
See application file for complete search history.

(56) References Cited

U.S. PATENT DOCUMENTS 3,771,901 A * 11/1973 Svensson ..... F04C 5/00 418/156
4,017,208 A * 4/1977 Vonnegut ..... F04C 5/00 415/90

(Continued)

FOREIGN PATENT DOCUMENTS

CN 1152676 6/1997
CN 101290002 10/2008

(Continued)

OTHER PUBLICATIONS

"International Search Report (Form PCT/ISA/210)"of PCT/CN2018/097126, dated Oct. 18, 2018, with English translation thereof, pp. 1-4.

*Primary Examiner* — Mary Davis
(74) *Attorney, Agent, or Firm* — JCIP Global Inc.

(57) ABSTRACT

Disclosed is a liquid pumping device, including a first component, a second component and a third component, wherein the second component moves relative to the first component in a fixed manner; a medium inlet and a medium outlet not in communication with each other are provided in a contact surface of the first component in liquid tightness sliding fit with the second component; a groove is provided in a contact surface of the second component in liquid tightness sliding fit, and the groove moves along a fixed path in the range of the contact surface in liquid tightness sliding fit; and the movement path of the groove respectively passes the medium inlet, the medium outlet and the third component, the third component is arranged on the side of the medium outlet in the forward movement direction of the groove, and when the groove moves forward through the third component, the part of the third component entering the groove extrudes the medium in the groove to the medium outlet. The quantification of liquid by the device of the (Continued)

present invention is determined by the groove, and the principle facilitates the control of the output precision of the pump.

12 Claims, 4 Drawing Sheets

(56) References Cited

U.S. PATENT DOCUMENTS

| | | | | |
|---|---|---|---|---|
| 4,028,021 | A * | 6/1977 | Berkowitz | F01C 1/22 418/56 |
| 10,465,681 | B2 * | 11/2019 | Hayes-Pankhurst | F04C 5/00 |
| 10,495,085 | B2 * | 12/2019 | Hayes-Pankhurst | F04C 5/00 |
| 10,935,025 | B2 * | 3/2021 | Hayes-Pankhurst | F04C 5/00 |
| 2014/0255164 | A1 * | 9/2014 | Hayes-Pankhurst | F04C 5/00 415/170.1 |

FOREIGN PATENT DOCUMENTS

| | | |
|---|---|---|
| CN | 202165260 | 3/2012 |
| CN | 203272084 | 11/2013 |
| CN | 105332873 | 2/2016 |
| JP | H11132140 | 5/1999 |

* cited by examiner

LIQUID PUMPING DEVICE WITH CONCAVE CAVES AND CONVEX LIQUID EXTRUDING COMPONENT

CROSS-REFERENCE TO RELATED APPLICATION

This application is a 371 of international application of PCT application serial no. PCT/CN2018/097126, filed on Jul. 25, 2018, which claims the priority benefit of China application no. 201710616433.3, filed on Jul. 26, 2017. The entirety of each of the above mentioned patent applications is hereby incorporated by reference herein and made a part of this specification.

BACKGROUND

Technical Field

The invention relates to a mechanical device for conveying liquid and in particular to a pump. It belongs to the technical field of mechanical engineering.

Description of Related Art

At present, there are many types of small and micro pumps with metering capabilities used in actual applications, such as gear pump, electromagnetic pump, diaphragm pump, peristaltic pump, screw pump, injection pump, plunger pump, etc. These pumps have different performance indicators because of their varying structures and working methods. The gear pump is characterized by high flow and high head, but reduced metering precision under small flow conditions. The electromagnetic pump is characterized by high-frequency pulsed injection that can guarantee micro flow and high precision, but low flow capacity, also it cannot be applied to high-viscosity media. The diaphragm pump has a higher flow than the electromagnetic pump, but it cannot be used for high-viscosity media. The peristaltic pump has accurate metering and a large controllable range of flow rate, but its metering precision is reduced or even cannot be used in high-viscosity media scenario. Screw pump can be suitable for high-viscosity media, and can ensure precision under small flow conditions, but its elastomer stator parts are wearing parts and have complicated shapes, with high costs for production and use, in addition, the variation of pressure of the medium at the input and output ends affects the flow. The injection pump is characterized by high precision and micro-flow control, which is also suitable for high-viscosity media, but it lacks continuous working ability. The plunger pumps, similar to syringe pumps, cannot continuously convey media when running at low speed, and they are not suitable for high viscosity media when running at high frequency and high speed. None of the existing types of pumps can meet the requirements for micro-conveying, high accuracy, high viscosity, simple structure, small volume, low costs for production and uses, etc.

SUMMARY

The objective of the present invention is to overcome various shortcomings of the existing pumps and provide a new type of pump for improving the quantitative output accuracy, implementing the micro output functions and expanding the range of applicable liquid media.

To achieve the objective, the present invention introduces and adopts the following technical solutions: A liquid pumping device, comprising a first component, a second component, and a third component, wherein the second component moves relative to the first component in a designated manner, and at least a part of the contact surface of the first component and the second component is in liquid tightness sliding fit;

The medium inlet and the medium outlet, not in communication with each other, are provided in the contact surface of the first component in liquid tightness sliding fit with the second component. At least one cave is provided in the contact surface of the second component in liquid tightness sliding fit with the first component. The cave moves in a designated path in the range of the contact surface in liquid tightness sliding fit, along with the movement of the second component. The movement path of the cave passes respectively the medium inlet and outlet on the first component and the third component. When the cave passes the third component, the third component at least partially enters the cave and fills the cave horizontally. The "horizontally" herein means perpendicular to the direction of movement of the cave;

The movement of the second component relative to the first component may be achieved by setting the first component fixed and the second component moving, or by setting the second component fixed and the first component moving. Their movement modes may be rotation, or translation, or a combination of rotation and translation.

The third component is arranged on the side of the medium outlet in the forward movement direction of the cave, and when the cave moves forward passing the third component, a part of the third component intrudes into the cave and extrudes the medium from the cave to the medium outlet.

Further, in order to achieve the reverse suction functions, the third component is located on the side of the medium inlet in the reverse movement direction of the cave. When the cave passes the third component in the reverse movement direction, a part of the third component entering the cave extrudes the medium in the cave to the medium inlet.

The third component can be arranged without gap with the medium outlet/medium inlet, by making the sides of the third component in the reverse/forward movement direction of the cave as a part of the edge of the medium outlet/medium inlet. It is in natural communication with the medium outlet/medium inlet, and the medium extruded from the cave by the third component directly enters the medium outlet/medium inlet;

Alternatively, the third component is separated from the medium outlet/medium inlet by a thin partition. When no cave passes, the sides of the third component in the reverse/forward movement direction of the cave are not in connection to the medium outlet/medium inlet. When the cave passes the medium outlet/medium inlet and the third component, the sides of the third component in the reverse/forward movement direction of the cave is in transient connection to the medium outlet/medium inlet respectively via the cave passing by. At this time, under the extrusion of the third component, the medium in the cave flows into the medium outlet/medium inlet through the part of the cave connecting the third component with the medium outlet/medium inlet.

The medium inlet/medium outlet may consist of two parts. The first part is a tunnel to the outside while the second part functions as a channel connecting the first part with the side of the third component in the reverse/forward movement direction of the cave. For example, the second part of the medium outlet/medium inlet can be a groove-shaped channel arranged in the contact surface of the first component in liquid tightness sliding fit with the second component, which connects the first part of the medium outlet/medium inlet and the side of the third component in the reverse/forward movement direction of the cave.

Optionally, the medium inlet and the medium outlet are two parts of one opening formed on the first component. The third component is set in the middle of the opening to form the medium inlet and the medium outlet that isolated.

Optionally, there is at least one group of caves and each group comprises at least one cave. The movement paths of the caves in a group are the same but different from the movement paths of other groups. The caves of each group are evenly arranged along the movement path.

Optionally, there are multiple groups of the medium inlets, the medium outlets, and the third components. Each group comprises one medium inlet, one medium outlet, and one third component arranged between the medium inlet and the medium outlet. Each group of medium inlets and medium outlets are provided alternatively on the movement paths of the cave groups.

Optionally, the inner surface of the cave is a smooth curved surface, and the front and rear edges of a cave are smoothly transitioned.

Optionally, an elastic convex portion adapted to the cave shape is provided on the third component. At least the medium outlet side of the elastic convex portion is in communication with the medium outlet. Further, the medium inlet side of the elastic convex portion of the third component is also in communication with the medium inlet.

Preferably, the cross section of the cave is arc-shaped, and the cross-section of the elastic convex portion of the third component is also arc-shaped.

Optionally, the contact surface of the first component and the second component is a plane. The second component rotates around an axis perpendicular to the contact surface, or the second component translates along the contact surface according to a designated path.

Optionally, the movement of the second component is a rotation movement. The contact surface of the first component and the second component in liquid tightness sliding fit is a plane perpendicular to the second component rotation axis or a revolution surface with the second component rotation axis as its axis.

Optionally, the first component is a cylinder liner, and the second component is a core of a rotating body. When the core rotates in the cylinder linear relative to the cylinder linear, the contour of the inner side of the cylinder liner matches the contour of the core side, and the inner side of the cylinder liner is in liquid tightness sliding fit with the core side;

The medium inlet and the medium outlet are arranged on the inner side surface of a section of the cylinder liner in the liquid tightness sliding fit with the core side. The cave or caves are arranged on the section of core side in liquid tightness sliding fit with the inner side of the cylinder liner;

The third component is arranged on the side of the medium outlet in the forward rotation direction of the core. When the core rotates forward, the cave on the core side passes the third component along with the rotating core, and a part of the third component intrudes into the cave and extrudes the medium in the cave to the medium outlet. The medium subsequently extruded to the medium outlet propels itself out through the outlet.

Further, the third component is located on the side of the medium inlet in the reverse rotation direction of the core. When the core rotates reversely, the cave on the core side passes the third component with the reverse rotation movement of the core, and a part of the third component entering the cave extrudes the medium in the cave to the medium inlet.

Taking a single cave as an example, its working principle is as follows: when the cave rotates with the core and it is in communication with the medium inlet, the medium in the medium inlet enters the cave. With the core rotates further, the cave is separated from the inlet. The cave forms a closed cavity with the inner surface of the cylinder liner, with the help of the liquid tightness sliding fit between the cylinder liner and the core. The cavity is full of medium. The further rotating of the core brings the cave, firstly, to connect to the medium outlet, then secondly, to pass through the third component. The surface of the third component is closely attached to the core side. When the cave on the core side passes the third component, the third component elastically deforms or is partially pushed into the cave by the external force, causing the medium stored in the cave to be extruded out, squeezed to the medium outlet and eventually propelled out. The third component keeps filling the cave horizontally, so that the medium is blocked and not able to reach the other side of the third component. When the core continues to rotate, the cave moves away from the third component and is in communication with the medium inlet again, hence to repeat the periodic routine.

Optionally, the third component is made of a soft material, for example, soft and elastic rubber. The third component is installed in a closed space, with an external force pushing or squeezing the third component towards the core side. When the cave rotates with the core and passes the third component, a part of the soft and elastic third component intrudes into the cave and fully fills the cave at least in one axial section. With the cave rotating further, the medium inside the cave is extruded out towards the opposite direction of the rotation.

Further, the front and rear edges of the cave are smooth transition to the core side. Further, intersection curve of the cave surface and the core side is a smooth changeover.

Further, a third component mounting hole is provided on the cylinder liner. It is elastically sealed between the side of the third component and the wall of the mounting hole.

Further, the front end surface of the third component with the elastic convex portion is an arc surface matching the curve of the core side. The front end surface of the third component always attaches tightly with the core side in a sealed status.

Further, the third component provides a cavity structure, which is open at its rear side. A spring is set in the cave of the third component to press the front and side walls of the cave in the third component.

Optionally, the caves are evenly arranged in the circumferential direction. Further, there are multiple rows of caves, and in each row the caves are evenly arranged in the circumferential direction. Further, any two rows of caves are arranged in an interlacing position in the core rotation direction. Further, multiple elastic convex portions are provided by the third component, each convex portion for a row of caves respectively.

Preferably, the core is a cylindrical structure, and the cylinder liner is a cylindrical sleeve. The core of the cylindrical structure may be a cylinder, and the cylinder liner is a cylindrical sleeve. Or, the core is a tapered cylinder with a smaller taper, and the cylinder liner is a tapered cylindrical sleeve with the same taper as the core. A smaller taper is provided to adapt the tolerance in parts manufacture and ensure the liquid tightness sliding fit between the contact surfaces in the assembly.

Further, the core provides a spindle which is fixedly assembled with the core. The driving device clutches the spindle to make the core rotate. A seal ring and a seal ring adapter are respectively provided on the upper and lower ends of the core to prevent leakage of the medium. Snap springs are provided next to both seal ring adapters. A snap spring groove is provided at both ends of the inner side of the cylinder liner for mounting the snap springs.

Optionally, the cylinder liner is the pump shell. As an improvement, the cylinder liner is a separate component mounted in a pump shell. The outer side of the cylinder liner is tightly fixed to the pump shell. The shell also provides a medium inlet, a medium outlet and a third component mounting hole corresponding to the medium inlet, the medium outlet and the third component mounting hole on the cylinder liner. The medium inlet and the medium outlet on the pump shell are connected to the inlet and outlet pipelines, and a cover plate is provided on the outside of the third component mounting hole on the pump shell. As there is friction between the cylinder liner and the core, the design of the cylinder liner as an independent component separated from the pump shell can facilitate the selection of different materials according to the functions of the cylinder liner.

Further, the cylinder liner and the core are both made of ceramic material.

The present invention has the following beneficial effects: the cave on a rigid core that can pass through the inlet and the outlet during the rotation is provided as a container to carry liquid medium from the inlet to the outlet. The amount of conveyed liquid medium each time is determined by the volume of the cave, which is irrelevant to any elastic parts, therefore, the quantitative uncertainty caused by the elastic deformation of the elastic parts is eliminated. Based on this principle, the liquid pump is very beneficial for metering the output volume in high precision.

Notes: 1. pump shell, 2. cylinder liner, 3. seal ring adapter, 4. core, 5. cover plate, 6. spindle, 7. seal ring, 8. third component, 9. spring, 10. cave, 11. snap spring, 12. medium inlet, 13. medium outlet, 14. elastic convex portion, 21. first component, 22. second component.

DESCRIPTION OF THE EMBODIMENTS

The principle and basic structure of the liquid pumping device of the present invention will be further illustrated below with reference to the accompanying drawings.

FIGS. 1 to 4 show an optional structural form of the liquid pumping device according to the present invention. The overall structure is a columnar structure, the first component is cylindrical, the second component is cylindrical, and the two components are assembled coaxially, and the second component moves rotationally.

Figure 1:
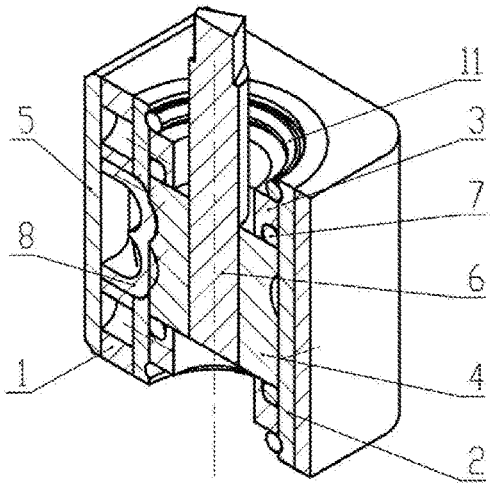
FIG. 1 is a schematic structural view of a liquid pumping device of the present invention.

Referring to FIG. 1, in this example, the device includes four main components: a pump shell 1, a cylinder liner 2, a core 4, and a third component 8. The cylinder liner 2 is independent of pump shell 1 and is made of a material with higher hardness and better wear and tear resistance than the shell. The cylinder liner 2 is a cylindrical sleeve that fixed tightly with the pump shell 1. The core 4 is a circular cylindrical structure and is assembled in the cylinder liner 2. The inner side of the cylinder liner 2 is liquid tightness sliding fit with the core 4 side surface. The cylinder liner 2 and the pump shell 1 together form a pump body. The two sides of the pump body are respectively provided with a medium inlet 12 and a medium outlet 13. The inner end openings of the medium inlet 12 and the medium outlet 13 are located on the inner side of the cylinder liner 2 and the outer end openings are located on the outer surface of the pump shell 1. A third component mounting hole is provided between the medium inlet 12 and the medium outlet 13, and the third component 8 is arranged in the third component mounting hole. There is cave 10 on the side of the core 4. During the rotation of the core, the cave 10 passes the inner end opening of the medium inlet 12 and the inner end opening of the medium outlet 13 successively; the third component 8 is arranged on the side of the medium outlet 13 in the forward rotation direction of the core. An elastic convex portion 14 is provided on the front end surface of the third component 8.

Figure 2:
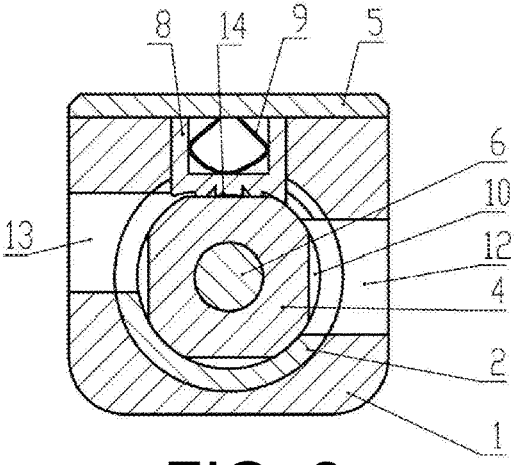
FIG. 2 is a schematic structural cross-sectional view of the liquid pumping device shown in FIG. 1.

Referring to FIG. 2, four caves 10 are evenly arranged on the side of the core 4 along the circumferential direction. The caves are equal in size and shape. The length of the cave in the circumferential direction of the core is shorter than the minimum interval arc length between the inner end opening of the medium inlet and the inner end opening of the medium outlet. The periphery of each cave has a smooth transition with the surface of the core contour, and any cross section of the cave is arched with the same arc. The contour of the elastic convex portion has matching arc shape. The rear side of the elastic convex portion is in communication with the medium outlet through a channel.

The side of the third component 8 is tightly attached to the third component mounting hole and fully seals the hole. The third component is a cavity structure with an opening at the rear end. A spring 9 is provided in the cave of the third component, and the spring presses the front wall and the side wall forward and around. The front end surface of the third component has an arc surface with the same arc as the core side, and the front end surface of the third component is always tightly sealed with the core side. A cover plate 5 is provided on the outer side of the third component mounting hole, and the cover plate 5 is assembled on pump shell 1 by means of screws or buckles.

Figure 3:
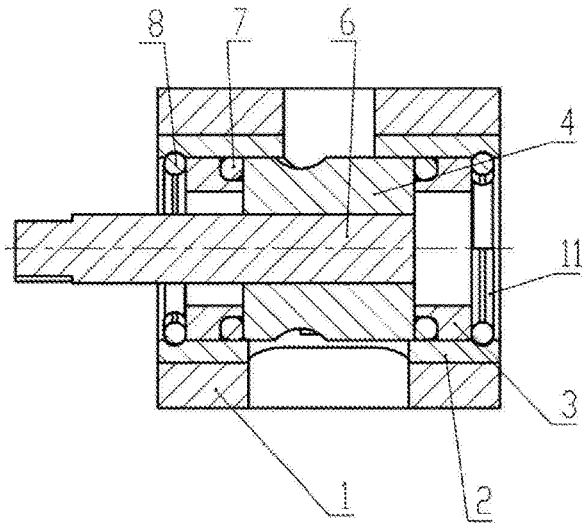
FIG. 3 is a structural schematic view of a longitudinal section of the liquid pumping device shown in FIG. 1.

Referring to FIG. 3, the core 4 axis is provided with a spindle 6, and the spindle 6 is fixed with core 4. The driving device makes the core to rotate by turning the spindle. A seal ring 7 and a seal ring adapter 3 are respectively provided on the upper and lower end surfaces of the core to prevent leakage of the medium. A snap spring 11 is provided outside of the seal ring adapter 3 at both ends. The inner side of the cylinder liner is provided with snap spring grooves at both ends for mounting the snap spring 11.

Figure 4:
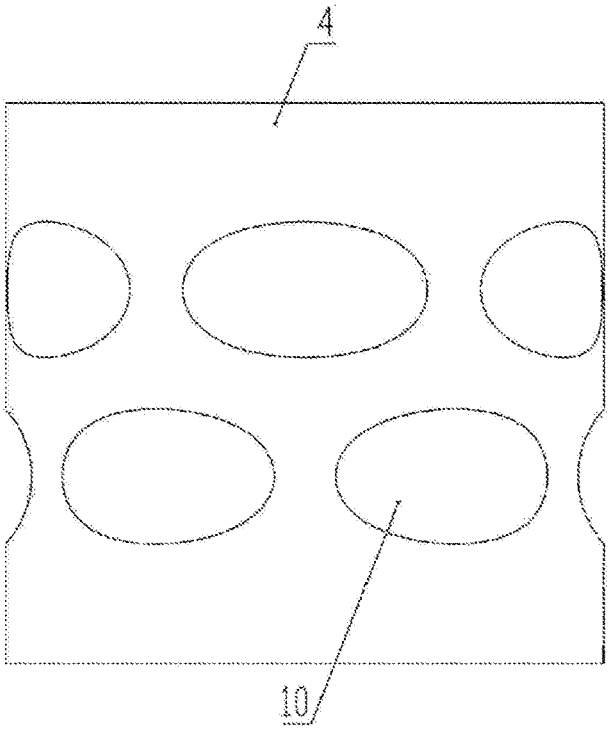
FIG. 4 is a schematic view of the surface structure of the core of the liquid pumping device shown in FIG. 1.

Referring to FIG. 4, there may be multiple rows of caves 10. In this example, there are two rows, each row includes six caves, and the six caves in each row are evenly arranged along the circumferential direction of the core surface. There are two elastic convex portions on the third component corresponding to each row of caves, respectively. The two rows of caves are arranged at 30 degrees offset from each other in the circumferential direction.

Figure 5:
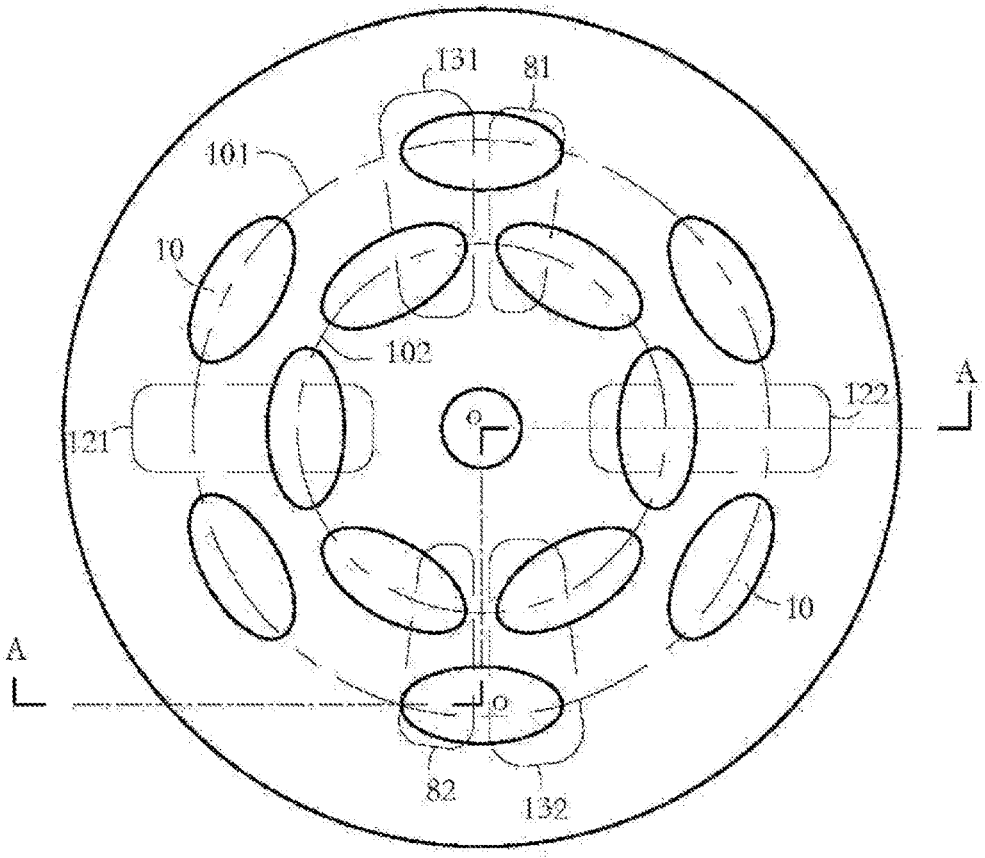
FIG. 5 is a schematic structural view of another structure form of a liquid pumping device of the present invention.
Figure 6:
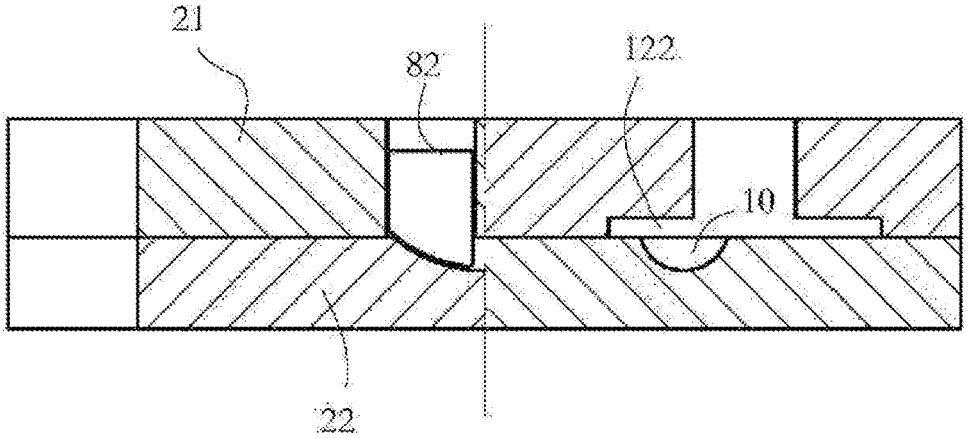
FIG. 6 is an A-o-o-A sectional view of the liquid pumping device shown in FIG. 5.

FIGS. 5 and 6 show another optional structural form of the liquid pumping device according to the present invention. The device has a disc-shaped structure as a whole. Both the first component 21 and the second component 22 have a circular planar structure. The contact surface is a plane, performing a liquid tightness sliding fit. The second component 22 rotates around the center of the circle, taking clockwise as the forward direction. Two groups of caves 10 are provided along two cave movement path 101 and 102 on the second component 22 respectively, 6 caves for each group. The caves from 2 groups are arranged in an interlacing order. A first medium inlet 121, a first medium outlet 131, a first third component 81, a second medium inlet 122, a second medium outlet 132, and a second third component 82 are arranged on the first component 21 in a circumferentially clockwise direction. Wherein, the first medium outlet 131 is set near the first third component 81, and the second medium outlet 132 is set near the second third component 82. The radial widths of the first medium inlet 121, the first medium outlet 131, the first third component 81, the second medium inlet 122, the second medium outlet 132 and the second third component 82 are greater than the total radial width of the two rows of caves.

Figure 7:
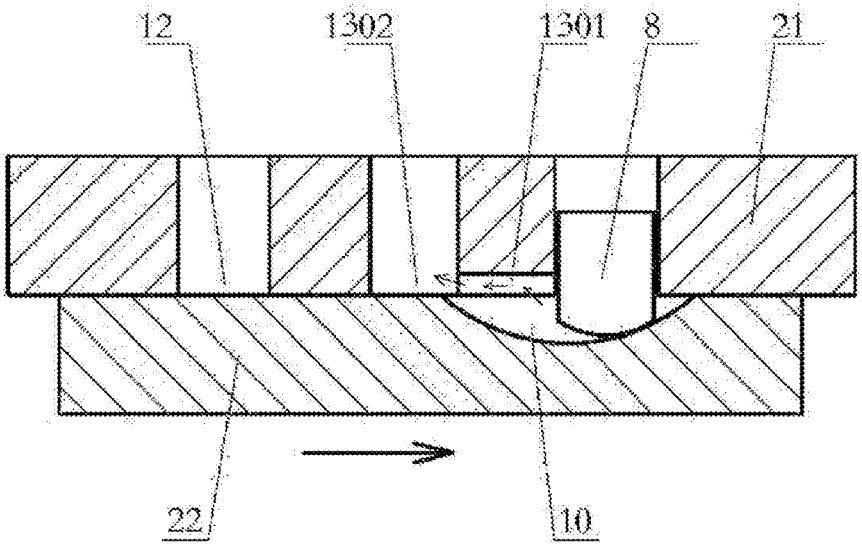
FIG. 7 is a schematic structural view showing normal communication by a groove-shaped channel between a medium outlet and the side of the third component in the reverse movement direction of the cave.
Figure 8:
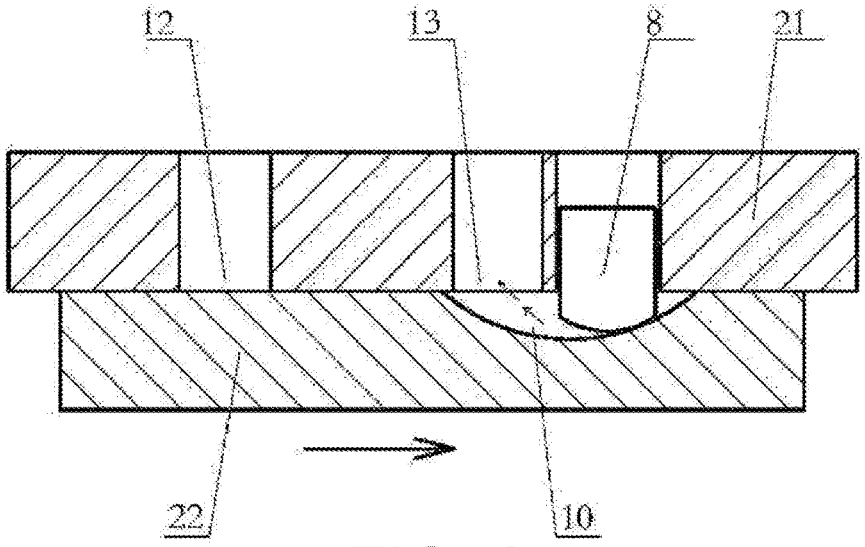
FIG. 8 is a schematic structural view showing transient communication by the cave passing between a medium outlet and the side of the third component in the reverse movement direction of the cave.
Figure 9:
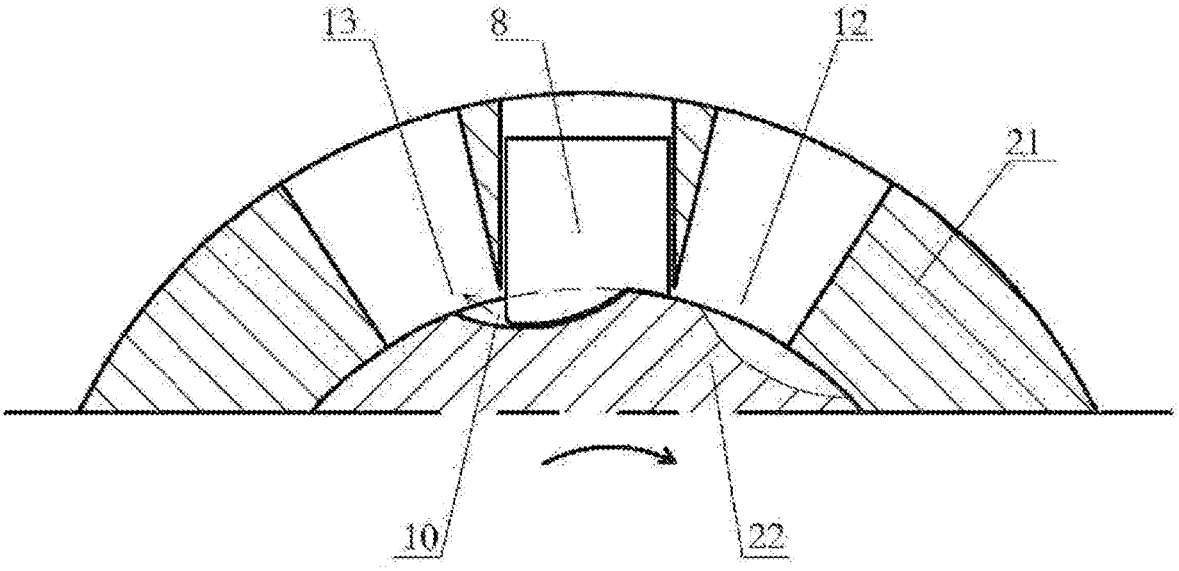
FIG. 9 is a schematic structural view showing the direct normal communication between the medium outlet and the side of the third component in the reverse movement direction of the cave.

Referring to FIGS. 7 to 9, three typical forms of communication between the medium outlet 13 and the third component 8 on the side of the medium outlet are shown. Of which, FIG. 7 is a schematic structural view showing the normal communication by a groove-shaped channel 1301 between the medium outlet and the third component on the side of the medium outlet. The medium outlet consists of a first part 1302 and a groove-shaped channel 1301 as a second part. The forward movement direction of the second component is shown by the arrow. The cave 10 moves forward with the second component 22, and passes the medium inlet 12, the medium outlet, and the third component 8 sequentially. When the cave 10 moves through medium inlet 12, due to a negative pressure in cave 10, the medium in medium inlet enters the cave and fills it. When the cave 10 passes the third component 8, the top of third component intrudes into the cave, and the medium in the cave is extruded outwards to enter the groove-shaped channel 1301 of the medium outlet. The original medium in the groove-shaped channel 1301 is propelled into the first part 1302 of the medium outlet under the extrusion of the newly-entered medium.

FIG. 8 is a schematic structural view showing transient communication via the cave connecting the medium outlet and the side of the third component in the reverse movement direction of the cave. There is a thin section between the medium outlet 13 and the third component. When no cave sitting between them, the medium outlet 13 is not in communication with the side of the third component in the reverse movement direction of the cave. While the cave passes through, the side of the third component in the reverse movement direction of the cave is in transient communication with the medium outlet 13 via the cave. At this time, under the extrusion of the third component, the medium in the cave enters the medium outlet 13 via the portion of the cave 10 that is in communication with the medium outlet.

FIG. 9 is a schematic structural view showing a scenario of the direct communication all the time between the medium outlet and the side of the third component in the reverse movement direction of the cave. The medium outlet 13 does not have a groove-shaped channel portion. When the cave passes the medium outlet 13 and the third component, the medium extruded from the cave by the third component directly enters the medium outlet 13.

What is claimed is:

1. A liquid pumping device, comprising a first component, a second component, and a third component, wherein the second component moves relative to the first component in a fixed manner, and at least a part of a contact surface of the first component and the second component is in liquid tightness sliding fit;

a medium inlet and a medium outlet, not in communication with each other, are provided in the contact surface of the first component in liquid tightness sliding fit with the second component; at least one cave is provided in the contact surface of the second component in liquid tightness sliding fit with the first component; the cave moves in a fixed path in a range of the contact surface in liquid tightness sliding fit, along with a movement of the second component; a movement path of the cave passes respectively the medium inlet and the medium outlet on the first component and the third component; when the cave passes the third component, the third component at least partially enters the cave and fills the cave horizontally;

the third component is arranged on a side of the medium outlet in a forward movement direction of the cave, and when the cave moves forward passing the third component, a part of the third component entering the cave extrudes medium in the cave to the medium outlet, wherein the movement of the second component is a rotational movement, and the contact surface of the first component and the second component in liquid tightness sliding fit is a plane perpendicular to a rotation axis of the second component.

2. The liquid pumping device according to claim 1, wherein a side of the third component in a reverse movement direction of the cave is in natural communication with or transient communication with the medium outlet via the cave passing by.

3. The liquid pumping device according to claim 1, wherein the third component is located on a side of the medium inlet in the reverse movement direction of the cave, and when the cave passes the third component in the reverse movement direction, a part of the third component entering the cave extrudes medium in the cave to the medium inlet.

4. The liquid pumping device according to claim 3, wherein a side of the third component in the forward movement direction of the cave is in natural communication with or transient communication with the medium inlet via the cave passing by.

5. The liquid pumping device according to claim 3, wherein there is at least one group of caves and each group comprises at least one cave; the caves in same group share a movement path; each group has different cave movement path; in each group, the caves are evenly arranged along the movement path.

6. The liquid pumping device according to claim 3, wherein there are multiple groups of the medium inlets, the medium outlets, and the third components; each group comprises one medium inlet, one medium outlet, and one third component arranged between the medium inlet and the medium outlet; each group of medium inlets and medium outlets is provided alternatively on the movement paths of a cave groups.

7. The liquid pumping device according to claim 3, wherein an inner surface of the cave is a smooth curved surface, and a front edge and a rear edge of the cave are smoothly transitioned.

8. The liquid pumping device according to claim 3, wherein an elastic convex portion adapted to a shape of the cave is provided on the third component.

9. The liquid pumping device according to claim 1, wherein there is at least one group of caves and each group comprises at least one cave; the caves in same group share a movement path; each group has different cave movement path; in each group, the caves are evenly arranged along the movement path.

10. The liquid pumping device according to claim 1, wherein there are multiple groups of the medium inlets, the medium outlets, and the third components; each group comprises one medium inlet, one medium outlet, and one third component arranged between the medium inlet and the medium outlet; each group of medium inlets and medium outlets is provided alternatively on the movement paths of a cave groups.

11. The liquid pumping device according to claim 1, wherein an inner surface of the cave is a smooth curved surface, and a front edge and a rear edge of the cave are smoothly transitioned.

12. The liquid pumping device according to claim 1, wherein an elastic convex portion adapted to a shape of the cave is provided on the third component.

* * * * *